US005356286A

United States Patent [19]

Sher

[11] Patent Number: 5,356,286

[45] Date of Patent: Oct. 18, 1994

[54] CHILD PROOF SAFETY LOCK LIGHTER

[75] Inventor: Tak C. Sher, North Point, Hong Kong

[73] Assignees: Polycity Industrial Ltd.; Tak Fi International (Holdings) Ltd., both of Quarry Bay, Hong Kong

[21] Appl. No.: 172,615

[22] Filed: Dec. 22, 1993

[51] Int. Cl.[5] ..... F23D 11/36

[52] U.S. Cl. ..... 431/153; 431/277

[58] Field of Search ..... 431/153, 277, 344, 255; 222/153, 402.11

[56] References Cited

U.S. PATENT DOCUMENTS

| | | | |
|---|---|---|---|
| 5,074,781 | 12/1991 | Fujita | 431/277 X |
| 5,092,764 | 3/1992 | McDonough et al. | 431/277 |
| 5,165,885 | 11/1992 | Iwahori | 431/153 |
| 5,197,870 | 3/1993 | Yang | 431/153 |
| 5,213,495 | 5/1993 | Pan | 431/344 |
| 5,215,458 | 6/1993 | Cirami | 431/277 |
| 5,224,854 | 6/1993 | Ansquer | 431/277 X |
| 5,271,731 | 12/1993 | Hsin-Chung | 431/254 |

FOREIGN PATENT DOCUMENTS

| | | | |
|---|---|---|---|
| 0296281 | 12/1988 | European Pat. Off. | 431/153 |

*Primary Examiner*—Carl D. Price

*Attorney, Agent, or Firm*—Ladas & Parry

[57] ABSTRACT

The invention is an improved lighter having a drum disposed in an upper portion of a lighter's lighter body, which drum rotates between a safety locked position and a lighter operational position. The drum comprises an arm which extends outward from the lighter body so as to be accessible to the user, and two upstanding stud members which extend into slots formed in the platform of a mounting frame disposed atop of the lighter body. The studs and slots are configured so that when the drum is in the safety locked position, the lighter's nozzle actuating lever cannot be moved a sufficient distance to cause the nozzle to be open.

4 Claims, 5 Drawing Sheets

CHILD PROOF SAFETY LOCK LIGHTER

BACKGROUND OF THE INVENTION

This invention relates to the field of lighters, such as cigarette lighters.

Modern butane lighters have become very popular. One of the reasons for their popularity is that the height of the flame produced by the lighter can be varied over a wide range by varying the amount of fuel allowed to be ejected from the lighter. However, the very feature which makes such lighters attractive to the users also makes such lighters extremely dangerous if they are accidentally ignited or if they are ignited by a small child. When the lighter produces a flame in an uncontrolled circumstance, particularly when the lighter is set on its high setting, materials (such as curtains, clothing, hair) may accidentally be lit on fire with the result being potential catastrophe.

The invention disclosed herein significantly reduces the risk that the lighter would accidentally cause damage by the provision of a safety lock feature which prevents the lighter's nozzle from being put into the open position unless the user deliberately puts the lighter in an operational condition. In a preferred embodiment of the invention, the safety lock mechanism of the invention is automatically engaged.

SUMMARY OF THE INVENTION

Conventional lighters comprise a lighter body within which is housed a reservoir containing butane or other suitable fuel, a mounting frame affixed atop the lighter body, a nozzle inserted through the mounting frame into connected relationship with the reservoir, a lever for actuating the nozzle, and an igniter such as a striker, flint, and flint spring combination, which igniter is positioned close to the rear end of the lever so that the igniter and the rear end of the lever may be actuated nearly simultaneously. When this occurs a flame is caused to be ignited from the head of the nozzle through which fuel is being ejected while the rear end of the lever is being held down.

The invention is an improved lighter which is attained by forming a recess in the upper portion of the lighter body approximately diametrically opposite to the nozzle. Disposed therein is a drum which rotates between first and second positions, a safety lock position and a lighter operational position, respectively. This drum comprises an arm which extends outward, so that it is accessible to the user, and two upstanding stud members. The stud members extend into slots formed in the mounting frame's platform. One of the upstanding stud members is taller than the other. The top of the taller stud member extends through one of the slots and above the platform, and has a shoulder extending outward from the top of the stud in a direction substantially perpendicular to the vertical axis of the lighter body. A spring is inserted between the underside of the drum and the bottom support surface of the recess. The spring is both a compression and torsion spring, and urges the drum both upward toward the platform and toward the safety lock position.

The rear end of the nozzle actuating lever has one or two legs extending downward therefrom. The first leg is disposed above the top of the first stud member when the rotating drum is in its first position. When the drum is in this first position, the shoulder atop the first stud member is vertically aligned over a portion of the platform so that when an attempt is made to press the rear end of the lever downward, the first leg engages with the top of the first stud member, the shoulder of which vertically engages the platform. In this circumstance the lever cannot move far enough to cause the nozzle to be actuated. That is because the coming of the shoulder into vertical engagement with the platform prevents the drum from being pushed further down into the recess. That in turn prevents the rear end of the lever from being pushed down further.

If the user wants to ignite the lighter, the user pushes down on the arm extending out from the drum so that the shorter stud member comes free from the slot within which it was located, and then the user rotates the drum to its second position and allows the spring to urge the drum upward so that the second, or shorter stud member, is received by the same slot in which the first stud member is located. With the first stud member moved to a far end of this slot, its shoulder, instead of being vertically aligned over a portion of the platform, is now vertically aligned over the slot. In the two leg embodiment of the invention, the first stud member is directly aligned under the second leg of the rear end of the lever when the drum is in the second (or operational) position. When the rear end of the lever is pushed down, the second leg comes in contact with the top of the first stud member and forces it down. Since the shoulder does not come into vertical engagement with the platform, the rear end of the lever is allowed to travel downward a sufficient distance so that the front end of the lever pulls the nozzle up into a position such that the fuel contained in the lighter may be ejected from the nozzle. The fuel, which is ignited as a result of the igniter being actuated at the same time that the rear end of the lever is pushed downward, will continue to be ejected for as long as the rear end of the lever is pushed down and the nozzle is kept open. Once the rear end of the lever is allowed to rise up, the spring will cause the drum to rotate to its first position. This occurs because the second stud member was freed from the first slot when the rear end of the lever was pushed fully downward. Thus the drum returns to the first position, and the lighter automatically returns to the safety locked condition.

DETAILED DESCRIPTION OF THE INVENTION

Figure 1:
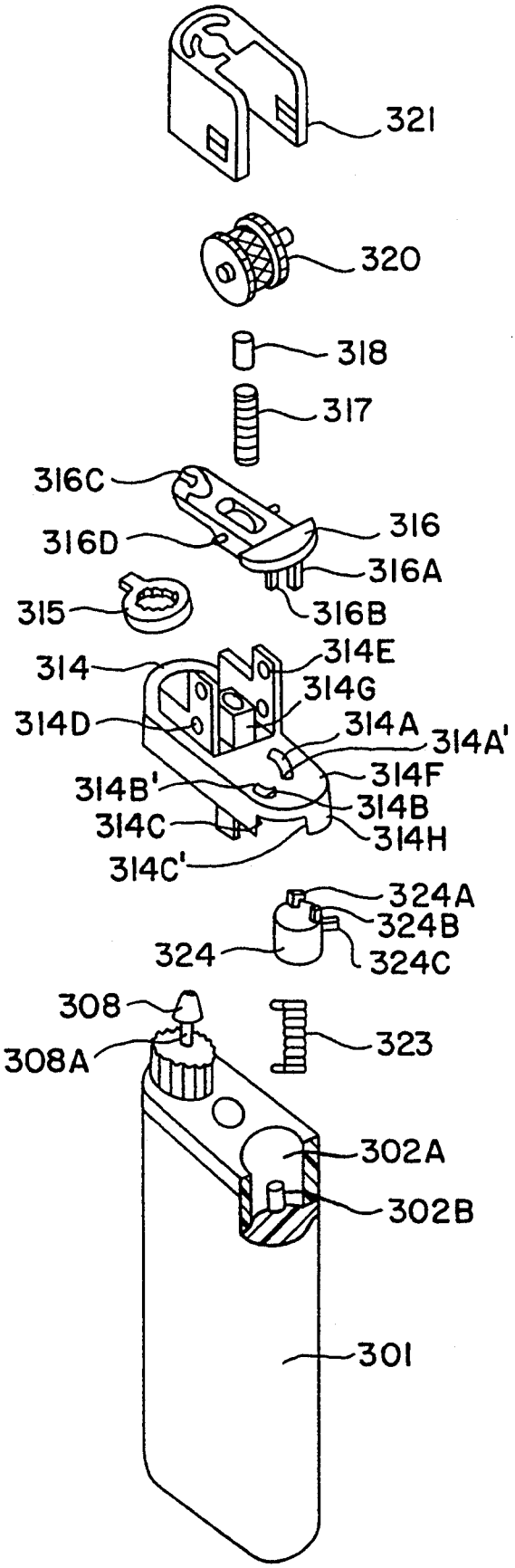
FIG. 1 is an exploded view of the safety lock lighter of the present invention.

The preferred embodiment of the subject invention is illustrated in the attached drawings which are referred to herein. The same reference numeral will be used to identify identical elements throughout the drawings.

FIG. 1 illustrates the rotating drum 324 and the spring 323 which are components of the safety means of the present invention. In addition, components commonly mounted on a lighter body 301 are illustrated such as nozzle 308, mounting frame 314, flame adjustment wheel 315, nozzle actuating lever 316, flint spring 317, flint 318, striker wheel 320, and wind shield 321.

To provide the safety means of the present invention, rotating drum 324 and spring 323 are disposed in the recess 302A formed at the junction of the top surface and the rear side surface of the lighter body. A mounting projection 302B may be used to help anchor the spring and the rotating drum within the recess. The rotating body 324 rotates under the dual action of the spring 323; that is, under the compressive (actually expansive) and torsional forces exerted by the spring. This causes the slip preventing studs 324A and 324B, which are upstanding from the upper surface of rotating drum 324, to be shifted between retaining slots 314A and 314 which have been formed in platform 314F of mounting frame 314. The slip preventing stud 324B exhibits the stopping function preventing the drum from rotating beyond the positions of the end point 314A' of retaining slot 314A and the end point 314B' of the retaining slot 314B. With the cooperation of the other slip preventing stud 324A on the rotating drum 324 and legs 316A and 316B on the nozzle actuating lever 316, the lever is controlled in its upward and downward movements to prevent accidental operation of the lighter. In addition, a handle in the form of arm 324C is provided on the rotating drum to allow the user to engage or disengage the safety means.

Referring to FIGS. 1, 2, 3 and 5, it can be seen that the lighter of the present invention comprises a drum 324 having a top drum surface and a bottom drum surface, and a side drum surface extending between the top and bottom surfaces. An imaginary drum axis extends along the center of the drum from the bottom drum surface to the top drum surface. The first and second stud members 324A and 324B, respectively, extend up from the top surface of the drum in a direction substantially parallel to the drum axis. The first and second stud members are disposed along the same arc about the drum axis. The drum also comprises a handle or arm member 324C which extends outward from the drum side surface in a direction substantially perpendicular to the drum axis.

As can be seen, the first stud member 324A is taller than the second stud member 324B, and the first stud member comprises at its upper end a shoulder which extends out in a direction substantially perpendicular to the drum axis and substantially parallel to the arc on which the first and second stud members are disposed. The shoulder atop the first stud member extends toward the second stud member.

The lighter also comprises a lighter body 301 having a top lighter body surface, a bottom lighter body surface and a side lighter body surface extending between the top and bottom lighter body surfaces. An imaginary vertical axis runs along the lighter body's center from the lighter body's bottom surface to its top surface. The lighter body comprises a reservoir 310 shown in phantom lines in FIG. 2 for storing fuel. An outlet port 311, also shown in phantom lines in FIG. 2, connects the reservoir to the top lighter body surface. A nozzle 308 having a head and a tube 308A extending down from the head (which tube is shown partially in phantom lines in FIG. 2), is inserted into the outlet port. The nozzle and outlet port are so configured that the nozzle reciprocates between a lower and upper position. When the nozzle is in the lower position the fuel stored in the reservoir cannot be ejected from the lighter, and when the nozzle is in its upper position, fuel from the lighter's reservoir is ejected through the head of the nozzle.

The lighter body also has a recess formed at the junction of the lighter body's top surface and its side surface, at a location which is diametrically opposite from the outlet port. The recess is configured to receive the drum with its axis being substantially parallel to the vertical axis of the lighter body. The recess is also configured so that the drum may move up and down in a direction parallel to the vertical axis and so that the drum may rotate about the drum axis from a first position to a second position. For this purpose, the recess may be formed with a mounting projection 302B, and a cavity 324D may be formed in the bottom surface of the drum 324. The recess is also configured so that arm 324C may extend outward from the side of the lighter body and be accessible to a user of the lighter.

A mounting frame 314 is affixed to the top surface of the lighter body. The mounting frame has a platform 314F which is disposed horizontally (i.e., in the plane perpendicular to the vertical axis of the lighter body). The platform has an opening 309 disposed over the outlet port, and the nozzle tube described above is disposed through that opening when it is being inserted into the outlet port. The nozzle head remains above the platform.

The mounting frame also has a fulcrum bearing structure 314D rising above the central portion of the platform 314F. And, mounted on the same structure that houses the fulcrum bearing member 314D is striker bearing member 314E into which striker wheel 320 is mounted. The flint spring 317 and the flint 318 are mounted upon the flint mounting structure 314G which also forms part of the mounting frame.

Figure 2:
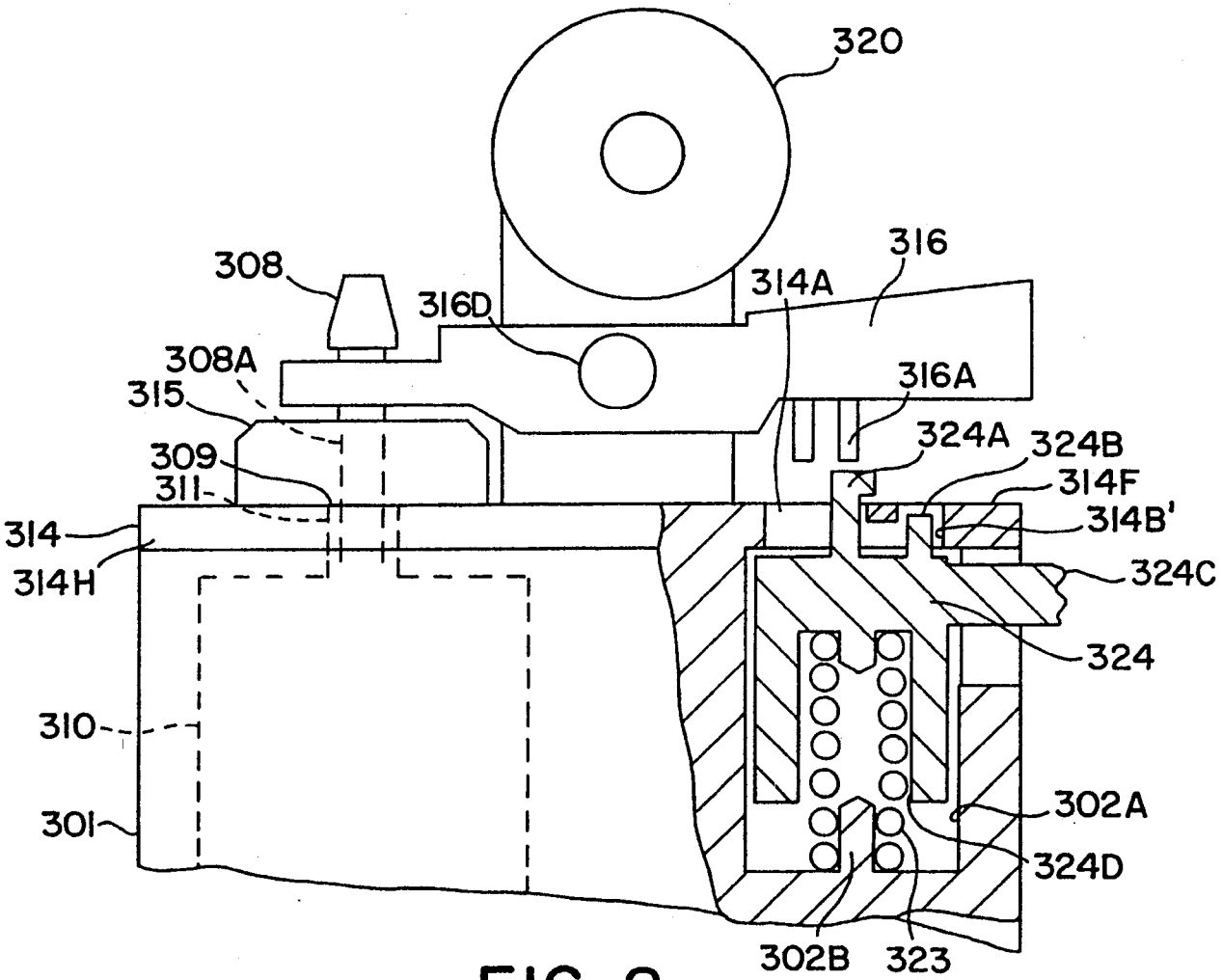
FIG. 2 is a partial side elevational view of the lighter of the present invention, partially broken away, illustrating the lighter in its safety locked condition, with the lighter's wind shield removed.
Figure 3:
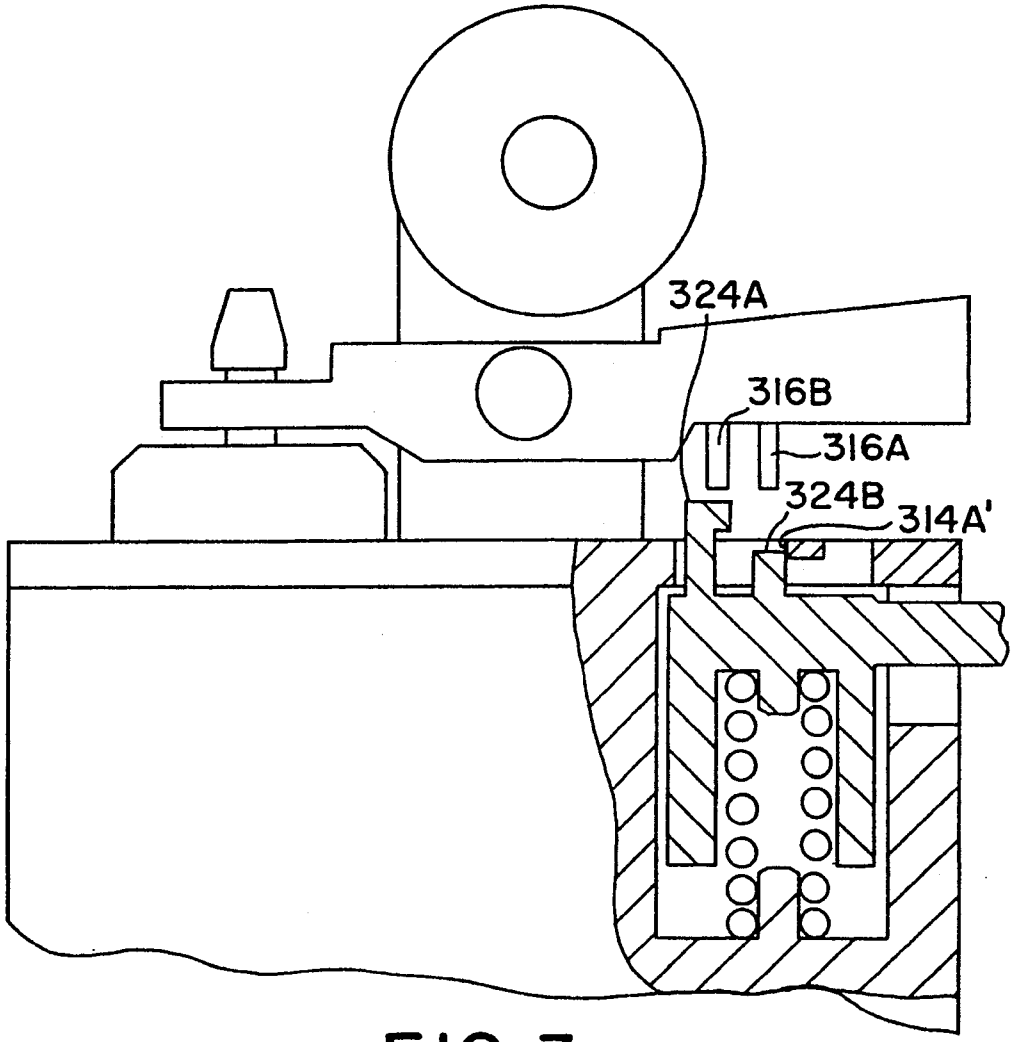
FIG. 3 is a partial side elevational view of the lighter of the present invention, partially broken away, illustrating the lighter in its operational condition, with the lighter's wind shield removed.
Figure 5:
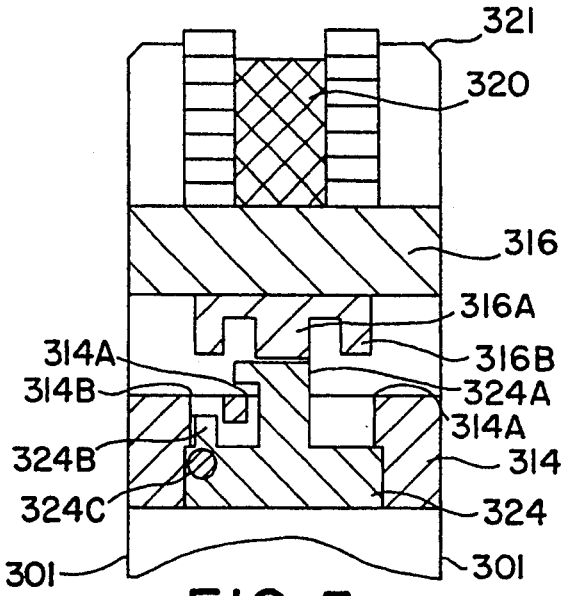
FIG. 5 is a partial rear cross sectional view of the lighter of the present invention illustrating the lighter in its safety locked condition.
Figure 6:
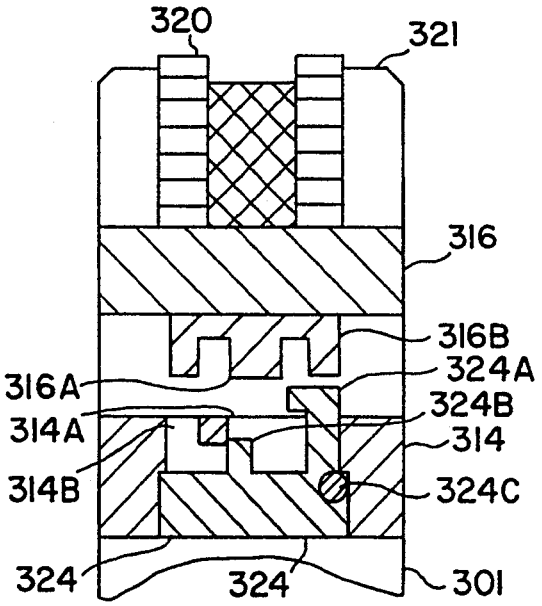
FIG. 6 is a partial rear cross sectional view of the lighter of the present invention illustrating the lighter in its operational condition.

Curved slots 314A and 314B are formed in the platform at the end of the platform which is diametrically opposite to the opening 309. These slots are positioned over the recess, with first stud member 324A extending through the first slot 314A when the drum is in its first, or safety locked position, as illustrated in FIGS. 2 and 5. The first slot is shaped so that it conforms to the path travelled by the first stud member as the drum rotates from its safety locked position (i.e., the first position) to the operational position (the second position). The second slot is also disposed above the recess. It is positioned above the location where the second stud member (i.e., the shorter stud member) is when the drum is in its safety locked position. At that moment, the shoulder of the first stud member extends vertically over that portion of the platform which is positioned between the first and second slots. When the drum is in the second or operational position, both the first and second stud members are positioned in the first slot and the shoulder of the first stud member extends over the slot, and not over a structural part of the platform, as shown in FIGS. 3 and 6.

The platform also has extending downward from its perimeter a skirt 314H, which snugly fits against the side surface of the lighter body.

A spring 323 is disposed in recess 302A with the bottom part of the spring mounted around projection 302B and the top part of the spring fitting into the cavity 324D formed in the bottom of the drum. The spring acts both as a compression and a torsion spring. It urges the drum upward toward the platform and it urges the drum to rotate toward the first or safety locked position.

Nozzle actuating lever 316 has its pivot axle or fulcrum 316D situated approximately across its middle. Its fulcrum is mounted in the fulcrum bearing member 314D of the mounting frame. The lever's front end has gripper 316C which grips the nozzle and causes the nozzle head to be raised when the rear end of the lever is pressed down. The rear end of the lever has a first leg 316A extending downward therefrom in vertical alignment with the first stud member when the drum is in the safety locked position, as shown in FIGS. 2 and 5. The length of the first leg member is such that when the rear end of the lever is pressed downward when the drum is in the safety locked position, the lever cannot travel sufficiently far to cause the nozzle to be lifted to its raised position. That is because the bottom of the first leg member engages with the top of the first stud member, the shoulder of which moves into vertical alignment with a portion of the platform structure thereby preventing further downward movement of the lever. As a result, while the drum is in the safety locked position, no flame can be accidentally lighted, as by a small child playing with the lighter.

The lighter also comprises striker wheel 320 mounted upon the striker support member 314E, as well as a flint 318 and flint spring 317 all of which comprise the igniter.

The lighter may be put in its operational condition by the user rotating the drum from its safety locked position to the operational position. This is done by the user pressing down on arm 324C which causes the drum to move downward in a direction away from the platform until the second stud member is freed from the second slot. The user then turns the arm and causes the drum to rotate until the second stud member is below a portion of the first slot. The user then allows the spring member 323 to push the drum upward toward the platform until the second stud member is received in the first slot, as shown in FIGS. 3 and 6.

When the drum is in the operational position, the first leg extending down from the rear of the nozzle actuating lever does not contact the first stud member as the rear of the lever is pushed downward. Therefore the rear of the lever may be pushed downward a far enough distance to cause the front end of the lever to pull the nozzle to its raised position. This allows the fuel to be ejected from the nozzle's head and the flame will be ignited when the igniter is actuated by the user. In the preferred mode the igniter is disposed in such a position that it may be struck almost simultaneously with the user's pushing the rear of the lever downward.

In the preferred embodiment of the invention, the rear of the actuating lever 316 has a second leg member 316B extending downward therefrom. The second leg member is positioned above the location where the first stud member is when the drum has been rotated to the operational position. The length of the second leg member is such that, when the rear end of the nozzle actuating lever is pressed downward while the drum is in the operational position, the second leg comes into vertical engagement with the top of the first stud member and causes the drum to be moved downward such that the second stud member is freed from the first slot. See FIGS. 4, 6 and 7. Because spring 323 is a torsion as well as compression spring, it urges the drum to rotate back toward the safety locked position. So, when the user releases the rear of the nozzle actuating lever, the second stud member is recaptured in the second slot and the lighter is automatically put back into the safety locked condition.

With the above structure in mind, the childproof safety lock lighter of the present invention works as follows. With reference to FIGS. 2 and 5, lever 316 is shown in the safety locked position, blocking the ejection of gas as a result of the safety means of the present invention. Leg 316A is blocked by the slip preventing stud 324A on drum 324 and thus cannot be pressed downward. At this moment, under the effect of torsional and expansive forces of spring 323, the other slip preventing stud 324B on drum 324 is maintained in its position in retaining slot 314B in the platform of mounting frame 314. The handle or arm 324C of the drum is positioned at the end point 314C in the opening in the skirt of platform 314F of the mounting frame 314. In this position, the drum can be pressed downward only a slight distance.

FIGS. 3 and 6 illustrate the lighter in the condition allowing for the ejection of gas from the nozzle. The handle or arm 324C of the drum 324 has been pivoted by hand to move arm 324C to the end point 314C' of the opening in the skirt of platform 314F of the mounting frame 314. The second stud member 324B had been removed from the retaining slot 314B and shifted to retaining slot 314A, and is pushed upward under the effect of the expansion force of spring 323 into the retaining slot 314A. The second stud member 324B is retained at end point 314A' in the retaining slot 314A under the effect of the torsional force of the spring 323. In addition, with the drum 324 in this position, the first stud member 324A is positioned under second leg 316B of the nozzle actuating lever 316.

Figure 4:
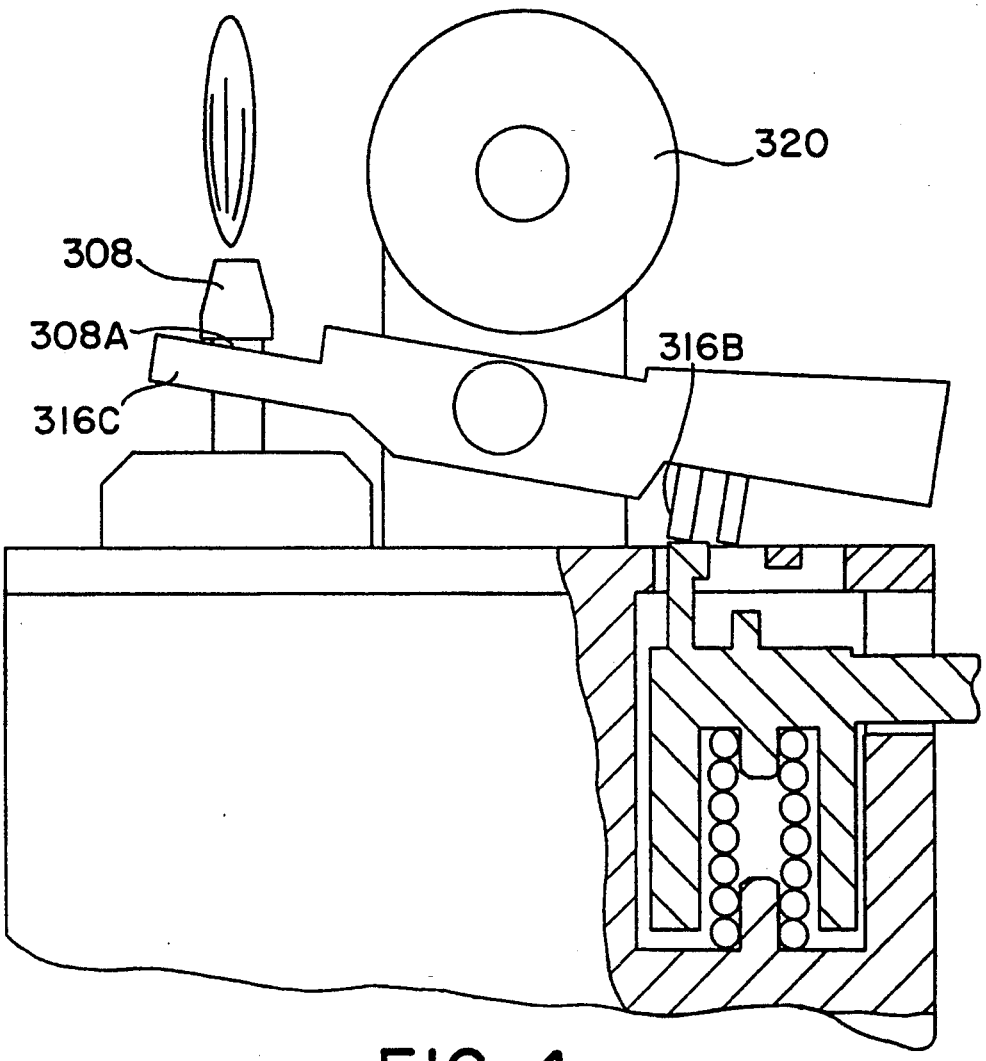
FIG. 4 is a partial side elevational view of the lighter of the present invention, partially broken away, illustrating the lighter in its operational condition and with its nozzle actuating lever in its actuating position, with the lighter's wind shield removed.
Figure 7:
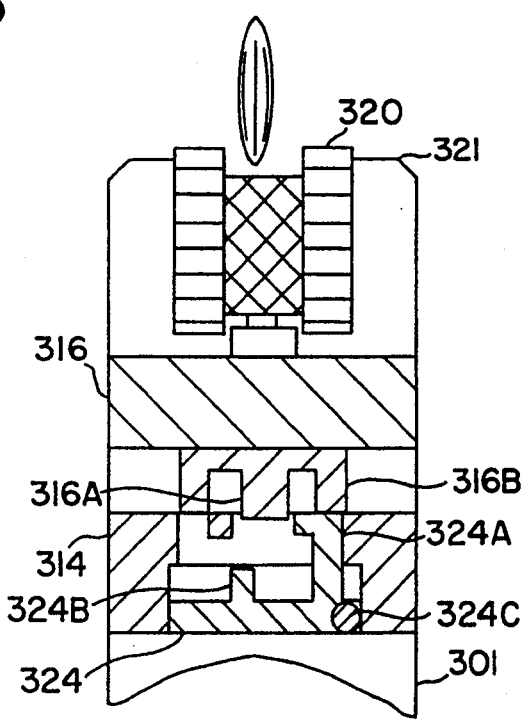
FIG. 7 is a partial rear cross sectional view of the lighter of the present invention illustrating the lighter in its operational condition with its nozzle actuating lever in its actuating position.

With reference to FIGS. 1, 4 and 7, the igniter's striker wheel 320 is actuated to strike the flint 318 to generate a spark. The rear part of the lever 316 is pressed downward at the same time that the striker wheel is actuated. The fulcrum 316D of lever 316 is mounted in the two bearing holes 314D on the mounting frame 314 which act as fulcrum bearings.

At this moment, leg 316B of the lever presses first stud member 324A downward into the retaining slot 314A. At the same time, the second stud member 324B separates from the retaining slot 314A and moves downward. The tendency of the drum 324 to rotate and return to the position in FIGS. 2 and 5 under the effect of the torsional force of the spring 323 is stopped through the frictional engagement of slip preventing stud 324A with the second leg 316B of the lever 316. The nozzle gripper at the front end of the nozzle actuating lever is formed by retaining slot 316C which clamps around the neck of nozzle 308A and raises the nozzle upward when the rear end of the lever is pressed downward.

The striker wheel 320 stops immediately after the instantaneous rotation for lighting a flame, while the ejection of gas and the flame are maintained during the period when the rear of the lever is depressed as shown in FIGS. 3 and 7.

After the lighter has accomplished its intended purpose, as for example lighting a cigarette, the user's finger pressing the rear of lever 316 will be removed and the rear of the lever moves upward and returns to the position shown in FIGS. 2 and 5. The nozzle is lowered. This cuts off the ejection of gas, and the flame from the lighter is extinguished. With the effect of torsional force of spring 323, the drum 324 rotates and second stud member 324B shifts to the position of the retaining slot 314B. Simultaneously, the second stud member 324B moves upward into the retaining slot 314B under the effect of the expansive force of the spring 323. Thus, the lighter returns to the safety locked position, preventing the accidental ejection of gas as shown in FIGS. 2 and 5.

Above there have been described a unique childproof safety lock lighter. It will be understood that various changes of the details, materials, arrangements of parts and uses which have been herein described and illustrated in order to explain the nature of the invention will occur to and may be made by those skilled in the art upon the reading of this disclosure, and such changes are intended to be included within the principles and scope of this invention.

I claim:

1. In a lighter having (a) a lighter body, said lighter body having a top surface, a bottom surface and a side surface extending between said lighter body's top surface and bottom surface, said lighter body having an imaginary vertical axis running along said lighter body's center from the lighter body's bottom surface to said lighter body's top surface, and said lighter body having a reservoir for storing fuel, said reservoir having an outlet port connected to the top surface of said lighter body through which outlet port said fuel is ejected when said lighter is in use;

(b) a nozzle through which said fuel is ejected after said fuel leaves said outlet port when said lighter is in use, said nozzle having a head with a tube extending down therefrom, (c) a mounting frame affixed atop said lighter body, said mounting frame having a platform disposed substantially in a plane perpendicular to said vertical axis, said platform having an opening disposed over the outlet port of said reservoir, wherein said nozzle tube is disposed through said opening and into said outlet port while said nozzle head remains disposed above said platform, and said mounting frame having a fulcrum bearing member disposed above a central portion of said platform, (d) a lever having a front end and a rear end, said lever having a fulcrum disposed intermediate said front and rear ends of said lever and mounted upon said fulcrum bearing member, said front end of said lever having gripping means for gripping said nozzle and causing said nozzle head to be raised when said rear end of said lever is pressed down, said nozzle and said outlet port being configured so that said fuel is allowed to be ejected from said nozzle when said nozzle is in a raised position and, when said nozzle is not in said raised position, said fuel is prevented from being ejected from said nozzle, and (e) an igniter mounted upon said mounting frame, said igniter being disposed such that a user may actuate said igniter substantially simultaneously with the user's pressing down upon the rear end of said lever, the improvement comprising the addition of lighter safety means, said lighter safety means comprising, a drum having an upper drum surface and a lower drum surface, and a side drum surface extending from said upper drum surface to said lower drum surface, said drum having an imaginary drum axis extending in a direction which is substantially parallel to said vertical axis, said drum having first and second stud members upstanding from the upper drum surface in a direction substantially parallel to said drum axis, said first and second stud members being disposed along an arc about said drum axis, and said drum having an arm member extending out from said side surface in a direction substantially perpendicular to said drum axis, said first stud member being longer than said second stud member, said first stud member having a shoulder disposed at an end of the first stud member which is remote from said upper drum surface, which shoulder extends out in a direction substantially perpendicular to said drum axis;

portions of said lighter body forming a recess in said lighter body, said recess disposed at the junction of said top and side surfaces of said lighter body and approximately below the rear end of said lever, said recess configured to receive said drum so that said drum may move up and down in directions parallel to said vertical axis and rotate back and forth from a first position to a second position about said drum axis with said arm member being accessible to said user;

portions of said platform forming a first slot, through which said first stud member extends above said platform, and a second slot, said first slot substantially conforming to the path travelled by said first stud member as said drum rotates from said first position to said second position, said second slot disposed to receive said second stud member when said drum is in said first position, wherein when said drum is in said first position said shoulder of said first stud member extends vertically over a portion of said platform, and when said drum is in said second position said second stud member is received in said first slot and said shoulder of said first stud member extends vertically over said first slot;

a spring disposed in said recess and against said drum, said spring acting to urge said drum upward toward said platform;

a first leg member attached to and extending downward from the rear end of said lever, said first leg member positioned above said first stud member when said drum is in said first position and having a length such that when the rear end of the lever is pressed downward while the drum is in said first position, said lever cannot travel sufficiently far to cause said nozzle to be lifted to said raised position before said shoulder of said first stud member moves into vertical engagement with said platform, thereby preventing further downward movement of said rear end of said lever, wherein said drum is rotated from said first position to said second position by the user pressing down on said arm member and urging the drum in a downward direction away from said platform until said second stud member is free from said second slot, turning said arm member until said second stud member is below a portion of the first slot, and then allowing the spring to push the drum upward toward the platform until the second stud member is received by said first slot.

2. The lighter safety means of claim 1, wherein said spring is a compression and torsion spring which urges said drum upward toward said platform and urges said drum to rotate from said second position to said first position, and wherein said safety means further comprises a second leg member attached to and extending downward from the rear end of said lever, said second leg member positioned above said first stud member when said drum is in said second position, said second leg member having a length such that when the rear end of said lever is pressed downward while said drum is in said second position, said second leg comes into vertical engagement with said first stud member and causes the said drum to be moved downward such that said second stud member is freed from said first slot, wherein when said rear end of said lever is no longer pressed downward said spring member causes said drum to rotate from said second position to said first position and to move upward so that said second stud member is received by said second slot.

3. A safety lighter comprising, a drum having an upper drum surface and a lower drum surface, and a side drum surface extending between said upper drum surface and said lower drum surface, said drum having an imaginary drum axis extending from the lower drum surface to the upper drum surface, said drum having first and second stud members upstanding from the upper drum surface in a direction substantially parallel to said drum axis, said first and second stud members being disposed along an arc about said drum axis, and said drum having an arm member extending outward from said side drum surface in a direction substantially perpendicular to said drum axis, wherein said first stud member is longer than said second stud member, said first stud member having a shoulder disposed at an end of the first stud member which is remote from said upper drum surface, which shoulder which extends out in a direction substantially perpendicular to said drum axis;

a lighter body having a top lighter body surface, a bottom lighter body surface and a side lighter body surface extending between said top lighter body surface and a bottom lighter surface, an imaginary vertical axis running along said lighter body's center from the lighter body's bottom lighter body surface to said lighter body's top lighter body surface, a reservoir for storing fuel, an outlet port connecting said reservoir to the top lighter body surface, and a recess disposed where said top lighter body surface and said side lighter body surface join at a location which is diametrically opposite from said outlet port, said recess configured to receive said drum so that said drum axis and said vertical axis are substantially parallel to each other, so that said drum may move up and down in a direction parallel to said vertical axis, and so that said drum may rotate about said drum axis from a first position to a second position with said arm member of said drum being accessible to a user of said safety lighter;

a nozzle through which said fuel is ejected after said fuel leaves said outlet port when said lighter is in use, said nozzle having a head with a tube extending down therefrom;

a mounting frame affixed to the top surface of said lighter body, said mounting frame having a platform disposed substantially in a plane perpendicular to said vertical axis, said platform having an opening disposed over said outlet port, said nozzle tube being disposed through said opening and into said outlet port while said nozzle head remains disposed above said platform, said platform further having a first slot disposed over said recess, with said first stud member extending through said first slot and above said platform, said first slot having a shape conforming to the path travelled by said first stud member as said drum rotates from said first position to said second position, said first slot being configured to receive said second stud member when said drum is in said second position, said platform further having a second slot disposed above said recess in the location where said second stud member is when said drum is in said first position, said second slot adapted to receive said second stud member when said drum is in said first position, said shoulder of said first stud member extending in a direction such that when said drum is in said first position said shoulder extends vertically over a portion of said platform, and when said drum is in said second position, said shoulder extends vertically over said first slot, said mounting frame further having a fulcrum bearing member disposed above a central portion of said platform;

a spring disposed in said recess and contacting said drum so as to urge said drum upward toward said platform;

a lever having a front end, a rear end and a fulcrum disposed intermediate said front and rear ends, said fulcrum being mounted upon said fulcrum bearing member of said mounting frame, said front end of said lever having gripping means for gripping said nozzle and causing said nozzle head to be raised when said rear end of said lever is pressed down, said nozzle and said outlet port being configured so that said fuel is allowed to be ejected from said nozzle when said nozzle is in a raised position, and, when said nozzle is not in said raised position, said fuel is prevented from being ejected from said nozzle, said rear end of said lever having a first leg member attached to and extending downward therefrom, said first leg member positioned above said first studmember when said drum is in said first position and having a length such that when the rear end of the lever is pressed downward while the drum is in said first position, said lever cannot travel sufficiently far to cause said nozzle to be lifted to said raised position before said shoulder of said first stud member moves into vertical engagement with said platform, thereby preventing further downward movement of said rear end of said lever;

an igniter mounted upon said mounting frame, said igniter being disposed such that a user may actuate said igniter substantially simultaneously with the user's pressing down upon the rear end of said lever, wherein said drum is rotated from said first position to said second position by the user pressing down on said arm member and pushing the drum in a downward direction away from said platform until said second stud member is free from said second slot, turning said arm member until said second stud member is below a portion of the first slot and then allowing the spring to push the drum upward toward the platform until said second stud member is received by said first slot.

4. The lighter of claim 3 wherein said spring is a compression and torsion spring which urges said drum upward towards said platform and urges said drum to rotate from said second position to said first position, and wherein said rear end of said lever further comprises a second leg member attached to and extending downward therefrom, said second leg member positioned above said first stud member when said drum is in said second position and having a length such that when the rear end of said lever is pressed downward while said drum is in said second position, said second leg comes into vertical engagement with said first stud member and causes the drum to be moved downward such that said second stud member is freed from said first slot, wherein when said rear end of said second lever is no longer pressed downward said spring member causes said drum to rotate from said second position to said first position and to move upwards so that second stud member is received by said second slot.

* * * * *